United States Patent [19]

Rizzo

[11] 4,261,143

[45] Apr. 14, 1981

[54] PITCHED ROOF SUPPORT STRUCTURES

[76] Inventor: Michael Rizzo, 546 Oak St., Massapequa, N.Y. 11758

[21] Appl. No.: 59,307

[22] Filed: Jul. 20, 1979

[51] Int. Cl.[3] ..... E04B 7/04; E04B 7/16

[52] U.S. Cl. ..... 52/16; 52/11; 52/73; 52/92; 52/263

[58] Field of Search ..... 52/11, 16, 66, 72, 73, 52/74, 263, 282, 90, 92

[56] References Cited

U.S. PATENT DOCUMENTS

| | | | |
|---|---|---|---|
| 591,611 | 10/1897 | Stran | 52/90 |
| 2,834,072 | 5/1958 | Miller | 52/66 X |
| 3,061,978 | 11/1962 | Elia et al. | 52/90 |
| 3,196,992 | 7/1965 | Owen | 52/282 |
| 3,263,389 | 8/1966 | Heirich | 52/16 |
| 3,286,413 | 11/1966 | Wells | 52/16 |
| 3,411,251 | 11/1968 | Corry | 52/16 X |
| 3,893,269 | 7/1975 | Nelsson | 52/71 X |
| 3,932,968 | 1/1976 | Heirich | 52/90 X |
| 3,994,104 | 11/1976 | Gurrola | 52/90 |
| 4,100,703 | 7/1978 | Sickler | 52/16 |
| 4,100,704 | 7/1978 | Oogami | 52/282 X |

FOREIGN PATENT DOCUMENTS

| | | | |
|---|---|---|---|
| 628227 | 5/1963 | Belgium | 52/11 |
| 669874 | 1/1966 | Belgium | 52/11 |
| 1439306 | 4/1966 | France | 52/11 |

*Primary Examiner*—Alfred C. Perham
*Attorney, Agent, or Firm*—Bauer & Amer

[57] ABSTRACT

A universal structural support system for a pitched roof includes a front fascia gutter assembly, a setback beam assembly and an I-beam assembly, each of which comprises a first portion that is pitch-adjustable with the selected slope of the roof and relative to a second portion positionally fixed with respect to the underlying ground surface and to which the first portion is at least hingedly connected.

31 Claims, 9 Drawing Figures

PITCHED ROOF SUPPORT STRUCTURES

The present invention relates generally to pitched or sloped roof-type covers for use as appurtenances to buildings, and more particularly to structures for supporting the same.

In the construction of covers of the type which may serve as roofs for screened or otherwise enclosed rooms, a slope or pitch is usually imparted to the roof so as to prevent the accumulation thereon of rain water or snow and ice and to encourage proper drainage. The downward pitch of the roof outward from the building wall to which the same is generally attached may vary over a substantial angular range depending, inter alia, upon the size and extension of the roof and various functional and ornamental design consideration. As a consequence, specially fabricated or individually modified structural support members must often be provided for each roof construction so that the desired roof pitch or slope can be attained in the particular design situation. The result is significantly increased costs for the construction of covers of this type.

It is therefore the desideratum of the present invention to provide a system of universal structural supports for a pitched roof or cover that may be utilized in a wide range of designs without significant modification for the support of a roof at a selected pitch and irrespective of the size or extension of the roof.

Specifically, it is an object of the invention to provide a constructural arrangement of support structures for a pitched roof whereby the supporting framework may be initially constructed withour regard to the eventual pitch or slope of the roof and thereafter adapted for supporting connection to the roof.

It is another object of the invention to provide such pitched roof support structures with the capacity to bear substantial weights and forces acting on the supported roof.

It is a further object of the invention to provide a support structure at the leading edge of the pitched roof which includes an integral gutter for collecting and directing liquid runoff from the roof.

It is still another object of the invention to provide a support structure for a pitched roof which includes a gutter at the leading edge thereof whereby the support structure is set back from the leading edge of the roof so as to form a cantilever arrangement thereof.

These and additional objects of the present invention are attained in a constructural arrangement of support structures for a pitched roof which includes a front fascia gutter assembly, a setback beam assembly and an I-beam assembly, each of which is supportingly connected to the roof and is pitch-adjustable in accordance with the selected slope of the roof. More particularly, each of the individual support assemblies comprises a stationary portion which is positionally and angularly fixed with respect to the underlying ground surface and a movable portion hinged thereto which is adjustable to the angular slope of the roof and with respect to the stationary portion of the assembly. The leading edge of the roof which carries the front fascia gutter assembly may be supported in a cantilever-type arrangement with the setback beam assembly so that the leading edge of the roof extendedly overhangs supporting posts which extend upwardly from the ground surface for bearing the weight of the pitched roof construction.

The above brief description, as well as further objects, features and advantages of the present invention, will be more fully appreciated by reference to the following detailed description of presently preferred, but nonetheless illustrative embodiments in accordance with the present invention when taken in conjunction with the accompanying drawings, wherein.

Figures 3, 4, 5, 6, 7:
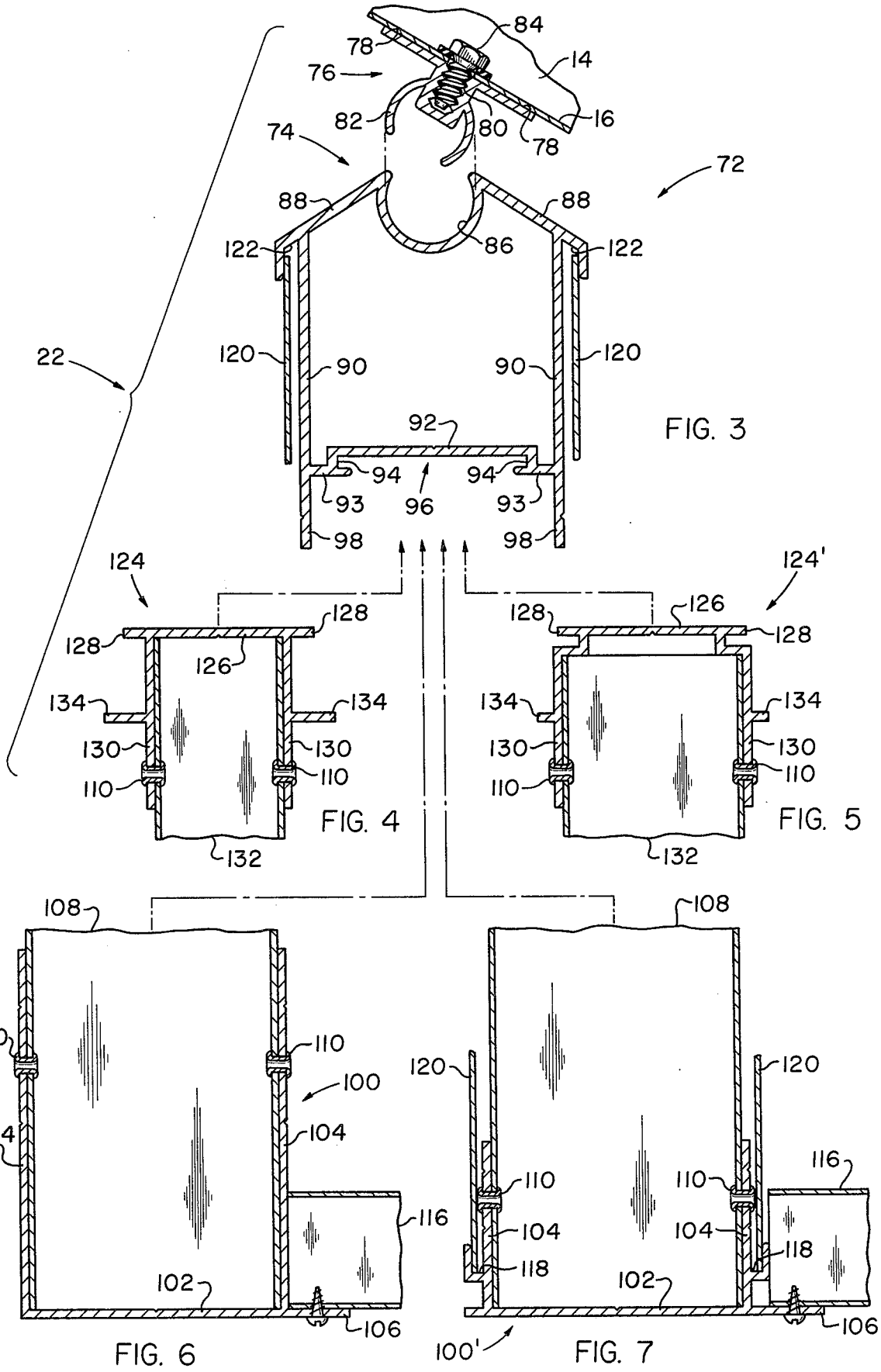
Figure 9:
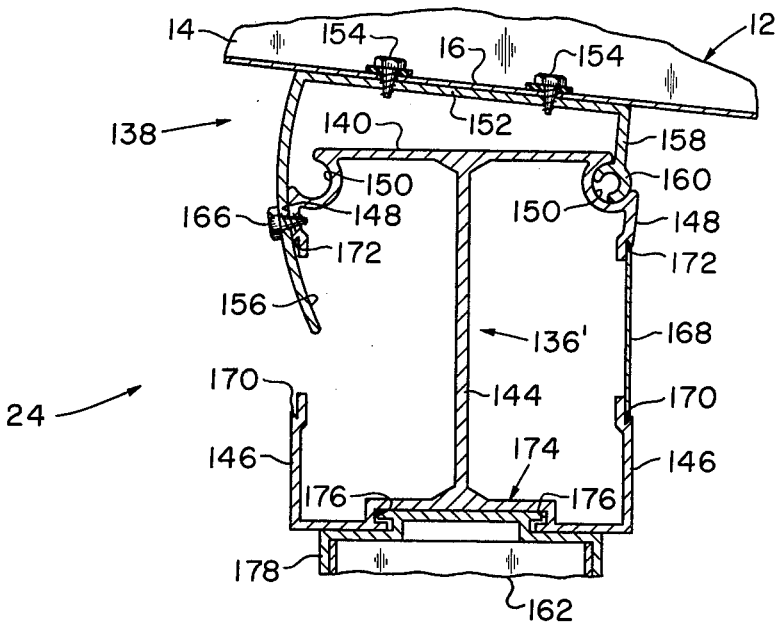
Figure 8:
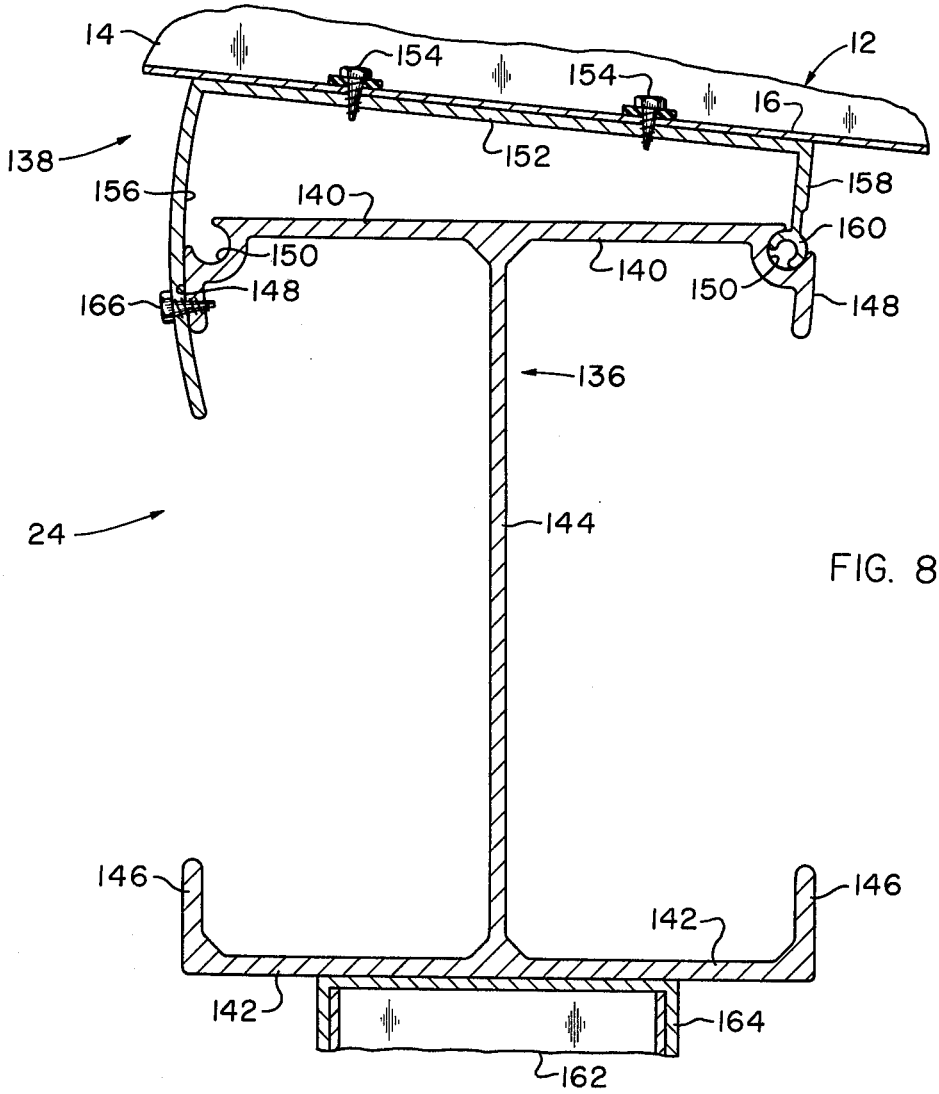

FIGS. 3–7 are cross-sectional end views, partially broken away, of various interengageable portions of a pitch-adjustable setback beam assembly in accordance with the present invention, in which FIG. 3 is a pitch-adjustable upper setback beam, FIGS. 4 and 5 are adapters for engagement with the upper setback beam, and FIGS. 6 and 7 are lower setback beams of the overall assembly; and FIGS. 8 and 9 are cross-sectional end views, partially broken away, of pitch-adjustable I-beam assemblies and their manner of connection to the roof and a supporting post.

DETAILED DESCRIPTION OF THE PREFERRED EMBODIMENTS

The present invention is directed to individual support assemblies for a selectively pitched or sloped roof cover in which each of the support assemblies includes a portion which is pitch-adjustable with the angular slope of the roof while another portion remains positionally and angularly fixed with respect to the underlying ground surface or floor. The invention additionally teaches an overall arrangement in which combinations of these supports assemblies are utilized to form a completed roof construction wherein the supporting framework formed of these assemblies may be initially constructed and positionally fixed relative to the underlying ground surface. The roof may thereafter be positioned supportedly atop the framework at a selected angular pitch since the individual support assemblies are ajustable to the selected pitch of the roof without disturbing their fixed positions relative to the ground surface.

Roof structures of the type generally contemplated by the invention include those commonly used as appurtenances to buildings such as private homes and commercial structures and the like. The roof may cover a screened-in or otherwise substantially enclosed room such as a porch constructed atop a patio of a private home wherein vertical walls are provided substantially along the edge-defined bounds of the roof. The roof structure may in the alternative merely cover an otherwise open area. In any event, the present invention, which is directed to the pitched roof support structure, is not intended to be limited by the end use of the roof construction or by the nature of the underlying space covered thereby.

Figure 1:
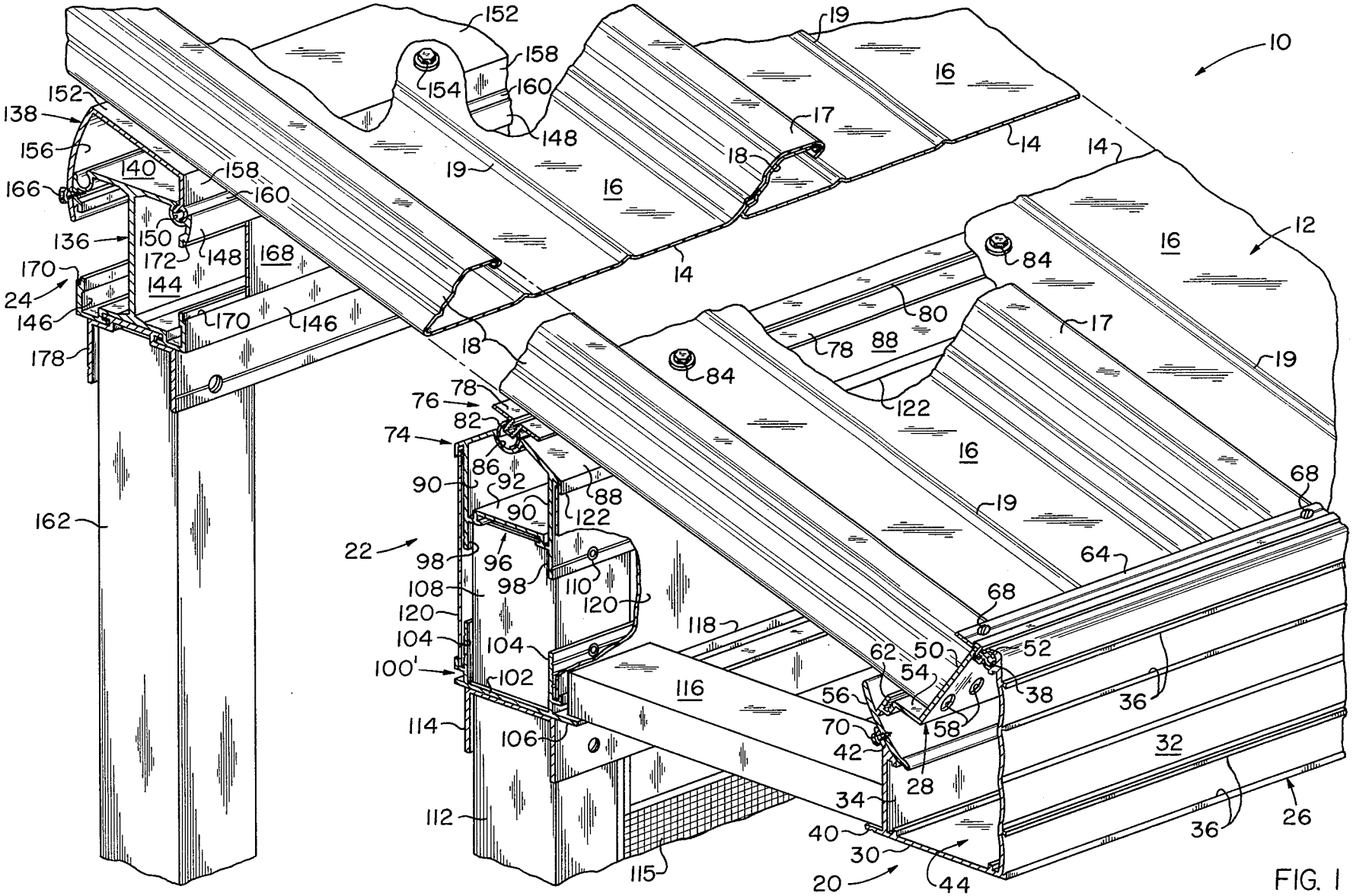
FIG. 1 is an elevational perspective view, partly in section and partly broken away, of a combination of pitch-adjustable assemblies connected with a sloped roof for supporting the same in accordance with the teachings of the present invention.

Referring now to the drawing, FIG. 1 illustrates an overall or combinational roof or cover construction designated by the general reference numeral 10 and which includes a roof 12 pitched or sloped at a selected angular orientation relative to the underlying ground surface or flooring (not shown). The roof 12 is formed of a plurality of roll-formed pans 14, each of which includes a substantially planar roof-defining surface 16 and a pair of interengageable upstanding roll portions 17, 18 along its respectively opposed marginal or side edges for effecting a coupled connection between adjacently-disposed ones of the roof pans 14 and for increasing the effective strength and rigidity of the sloping roof 12. Ribs or corrugations 19 may also be provided on the pan surfaces 16 to further enhance the structural rigidity of the roof.

Support of the roof 12 in an elevated position or relation above the ground surface may be accomplished through the provision of various support structures underlying the roof along its outward, downwardly sloping extension. Thus, a pitch-adjustable front fascia gutter assembly generally indentified 20 is connected to the forward or leading edge of the roof 12, while a pitch-adjustable setback beam assembly designated 22 is shown supporting the roof at a location rearwardly spaced from its leading edge. A variable-pitch I-beam assembly generally referred to by the numeral 24 is connected to the roof 12 for further support of the same at a location still further rearward of the setback beam assembly 22. The cooperative interaction of the assemblies 20, 22, 24 in their support of the roof 12, and the particular constructural characteristics and features of each assembly, will become readily apparent as this description proceeds.

The front fascia wall 32 is integrally formed along the forward-disposed marginal edge of the base 30 and may be provided on its outer face or surface with opposed pairs of trim cavities 36 for receiving decorative trim slats (not shown) to enhance the appearance of the fascia wall surface. A rearwardly-directed hinge or guide channel 38 unitarily carried at the upper end of the fascia wall 32 opposite its juncture with the base 30 is internally arcuately configured, being preferably spherical in cross-section and having an internal cross-section extent somewhat greater than a semi-circular or half arc.

The inner support wall 34 joins the base 30 at a location inwardly spaced from the rearwardly-disposed marginal edge of the base so as to define a shelf 40 integral with the base 30 and which extends a short distance beyond its juncture with the upstanding inner wall 34. The wall 34 is seen to vertically project from the base a distance less than the height of the front fascia wall 32 and unitarily carries at its upper extension a gradually curved guide and support surface 42.

The integrally formed or connected arrangement of the base 30 and upstandingly dependent walls 32, 34 bounds and defines a substantially U-shaped, elongated gutter 44 in and through the front fascia member 26. Liquid runoff, such as rain water, from the roof is collected in the gutter 44 as will hereinafter be described and is drained from the gutter through an outlet 46 located at a predetermined position along the gutter's elongation. A conventional drainpipe 48 may be connected with the outlet 46 for communicating the collected liquid runoff to the underlying ground surface for natural seepage or to a dry well or other catch basin.

Figure 2:
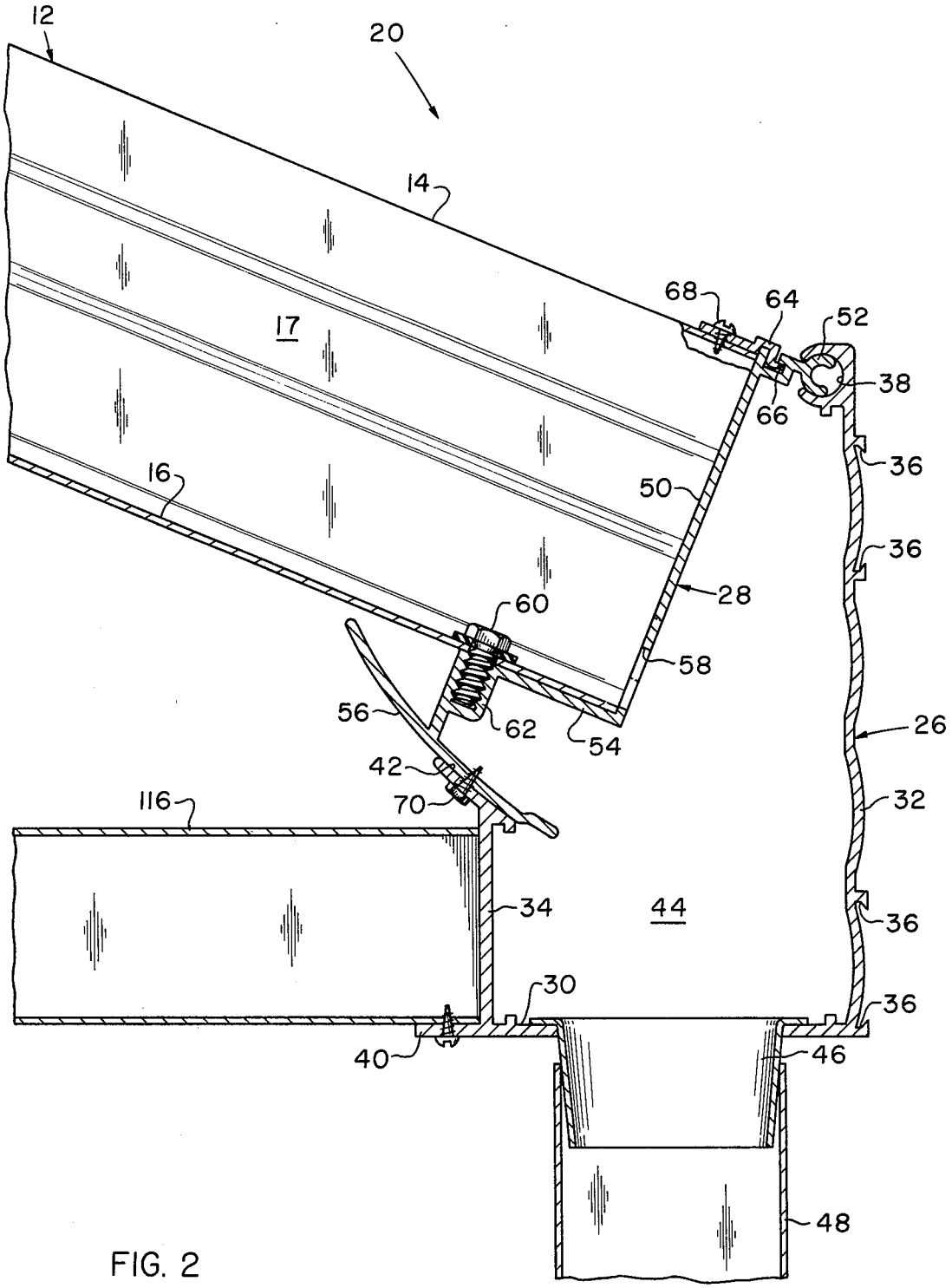
FIG. 2 is a cross-sectional end view of a pitch-adjustable front fascia gutter assembly in accordance with the present invention.

The pitch-variable front fascia gutter assembly 20 is perhaps best seen in FIG. 2. The assembly 20 essentially comprises a hinged arrangement of a front fascia gutter member 26 and a front pan hanger member 28, each of which may advantageously be unitarily extruded or otherwise formed of lightweight aluminum in a one-piece construction. The gutter and hanger members 26, 28 adjustably interengage for relative pitch variability in accordance with the selected angular slope of the roof 12 in a manner soon to be described.

The front fascia gutter member 26 includes a base 30 from which a front or outer fascia wall 32 and an inner support wall 34 upstandingly depend. Although not apparent in the cross-sectional depiction of FIG. 2, the hinged fascia gutter assembly 20 is seen in the perspective view of FIG. 1 to be elongated in design so that the same extends along the forward or leading edge of the pitched roof 12. Thus, it should be understood that the base 30 and the respective walls, 32, 34 depending therefrom, as well as each of the additional structural elements of the assembly 20 hereinafter described, are themselves correspondingly elongated. However, the inventive features of the gutter assembly 20 are understood to lie in the general and specific constructural details thereof, and accordingly the extent of the elongation of the assembly 20 and of its individual component parts is purely a matter of design choice and is not intended to limit or otherwise affect the scope of the invention.

The roof pan hanger member 28, which is seen in cross-section in FIG. 2, includes a roof abutment wall face 50 and a substantially C-shaped hinge 52 carried at the top-disposed end thereof. The hinge 52 is configured for pivotally movable engagement in and relative to the guide channel 38 of the gutter member 26 such that a hinged and non-releasable connection is achieved between the gutter and hanger members 26, 38. Engagement and disengagement of the hinge 52 and guide channel 38 is effected by way of relative sliding movement therebetween in a direction along the elongation of the gutter and hanger members 26, 28. As a result of this sliding engagement, the gutter and hanger members 26, 28 are non-releasably connected for pivotal adjustability therebetween.

A roof edge support surface 54 substantially normally extends from the opposite or lower end of the abutment wall face 50 and carries a hinge member 56 which is gradually curved so as to conform to the curvature of the gutter member guide surface 42. The conformingly curved guide surface 42 and hinge member 56 are contiguously arranged for relative sliding movement therebetween during pivotal adjustment of the pan hanger 28 with respect to the fascia gutter member 26, as will hereinafter be understood.

The hinged connection of the gutter and hanger member 26, 28 and the contiguous arrangement of the relatively slidable guide and hinge surfaces 42, 56 results in a substantial closure of the interior-defined U-shaped gutter 44. This closure is effective to prevent the accumulation in the gutter of leaves or other solide debris which might otherwise be windblown into the gutter and could thereby clog the same and thereby inhibit the collection and drainage of liquid runoff from the roof. Liquid runoff is provided access into the gutter 44 through a plurality of weep or drainage holes 58 defined in the wall face 50 which are predeterminately sized to frustrate the passage of leaves or large particulate debris therethrough.

In use, the hinged front fascia gutter assembly 20 is secured to the leading edge of the roof 12 for supporting the same and for collecting in its gutter 44 liquid which runs down the sloping or pitched roof. The hanger member 28 is fixed to the leading edge of the roof-defining roll formed pans 14 and the weight of the forward or leading portion of the roof 12 is transferred through the hanger member 28 to the front fascia gutter member 26 to which the same is hinged for supporting the weight of the roof. More particularly, the hanger member 28 is secured in a position of abutment against the leading edge of the adjacently disposed and interengaged roof pans 14 such that the planar surface 16 of the pans 14 rests atop the support surface 54 and the leading edge of the upstanding roll portions 17, 18 abuts the substantially perpendicular abutment wall face 50. Thus, the pitched roof 12 slopes downwardly to its leading edge and terminates in the relatively upstanding hanger member 28 fixed thereto whereby the support surface 54 is positioned parallel and the abutment wall face 50 perpendicular to the selectively pitched roof surface 16.

The hanger member 28 is positionally fixed to the leading edge of the roof 12 by the use of screws 60 journalled through the pan surface 16 and engaged with a threaded or ribbed screw boss 62 defined in the hanger member 28. Additional securement—more particularly directed to maintaining the leading edge of the pan roll portions 17, 18 in abutment with the wall face 50—may be attained by the provision of a hold-down bar 64 which engages in an L-shaped groove 66 in the hanger member 28 and pivots over the roof pan roll portions 17, 18 for securement thereto by way of screws 68 or the like.

Any variation in the pitch of the roof 12 carries with it the attached hanger member 28 and causes the same to pivot about the guide channel 38 with respect to the front fascia gutter member 26 to which the hanger member is hingedly connected. Relative pivotal movement of the hanger member 28 and gutter member 26 effects a corresponding relative sliding movement of the hinge member 56 against the curved guide and support surface 42. Those skilled in the art will accordingly appreciate that the ability to pivot the hanger member 28 will respect to the gutter member 26 permits the base or gutter surface 30 to remain in a fixed position relative to the underlying ground surface without regard to the selectively pitched position of the roof 12. Thus, the gutter member 26 need not be positionally or angularly moved or adjusted in response to any pivotal or angular change of the roof that must be made in adjusting the same to its selected pitch or slope. The only portion of the assembly 20 that is changed in its angular relationship is the hanger member 28, which is pivotally moved with respect to the front fascia gutter member 26.

Once the angular pitch of the roof 12 has been set, the relative pivotal position of the hanger and gutter members 28, 26 may be fixed or locked by securing together the slidably contiguous hinge member 56 and guide surface 42 with screws 70. By reason of this unitary connection, the front fascia assembly 20 is prevented from further pivotal adjustment and is essentially converted into an angularly-fixed edge supporting structure which includes an integral gutter 44. Rain water running down the sloping roof 12 impinges upon the edge terminating abutment wall face 50 and is permitted to pass into the gutter 44 through the predeterminately sized weep holes 58, while leaves and other large, particulate matter are prevented from entering the gutter.

Thus, support of the forward or leading portion of the roof 12 is attained by the provision of a pitch-adjustable front fascia gutter assembly 20 connected to the leading edge thereof. The weight of the leading roof portion, which is placed directly upon the hanger member 28, is transferred through the contiguous, complementarily curved guide and hinge members 42, 56, and through the cooperating guide channel 38 and hinge 52, to the gutter member 26 which is positionally fixed relative to the underlying ground surface. Positional fixing of the gutter member 26 may be attained by the use of conventional supporting posts or columns (not shown) secured to the underside of the gutter base 30 and supporting the gutter member 26 at an elevated position above the ground surface.

At times, however, it may not be possible or practical to position ground-based vertical support posts or columns under the front fascia gutter assembly 20 for supporting the leading portion of the roof above the ground surface. Similarly, a screened-in or enclosed room might include merely as a matter of design choice an overhanging front portion of the roof wherein the room-bounding front wall is set back from the roof's leading edge and the use of posts or columns supportedly extending downward from the leading edge is to be avoided. Naturally, a leading edge gutter must in any event be provided for collecting liquid runoff from the roof, and indirect support for the gutter arrangement and for the freely overhanging roof portion may be required to supplement that attributable to the rigidify and strength of the roof pans 14. The present invention contemplates such a design and accordingly provides a pitch-variable setback beam assembly 22 which may be utilized in conjunction with or independently of the front fascia gutter assembly 20 previously described.

The setback beam assembly 22 is seen in FIGS. 3 through 7 as a series of interengageable components. More particularly, FIG. 3 shows a cross-sectional view of a generally elongated upper setback beam generally designated 72 which forms the heart of the assembly 22 and which comprises a fixed female setback beam member 74 and a male setback hinge member 76 pivotally adjustable with respect thereto.

The male setback hinge 76 includes an elongated pan support surface 78 along the length of which a screw-receiving cavity 80 is defined. A substantially C-shaped hinge 82 extends from the walls bounding the cavity 80 in a direction rearward of the pan support surface 78. Securement of the male setback hinge member 76 to the roof pans 14 is effected using screws 84 journalled through the roof pan surface 16 and engaging within the cavity 80. The hinge member 76 is connected to the roof 12 at a location defined rearward of the leading edge of the roof such that the elongation of the support surface 78 extends substantially perpendicular to the angular inclination of the roof. As will be better understood as the description proceeds, the extent of roof overhang is determined by the location at which the male hinge member 76 is secured to the roof 12 with respect to the leading edge of the roof. In other words, direct support of the roof, by way of vertically-disposed ground-based columns or posts, will be provided at the location of the rearwardly spaced connection of the male setback hinge member 76 to the roof pans14.

The female setback beam 74 includes an arcuate guide channel 86 which hingedly and non-releasably receives by way of relative sliding movement therebetween the C-shaped hinge 82 for relative pivotal movement of the hinge. The guide channel 86 is defined in channel supporting members 88 which are in turn carried on a parallel pair of oppositely disposed, vertically upstanding setback walls 90. A rigidifying plate 92 extends between shoulder members 93 to bridge or connect the oppositely-disposed walls 90 at a location intermediate their vertical extension from the channel supporting members 88. The juncture of the rigidifying plate with the shoulders 93 forms end slots 94 which define a generally T-shaped adapter keyway designated 96. For convenience of description, the lower extensions of the setback walls 90 beyond the rigidifying plate 92 are identified by the reference numerals 98.

Thus, the upper setback beam 72 provides a pitch-adjustable structural arrangement for use in supporting a selectively sloped roof at a position rearwardly set back from the leading edge of the roof. The male setback hinge 76 which is secured to the roof pans 14 is angularly movable with respect to the female setback beam 74 to which the same is hingedly connected. As a consequence, when the female member 74 is positionally and angularly fixed with respect to the underlying ground surface, the roof pans 14 to which the male hinge member 76 is secured are angularly adjustable to a selected pitch without affecting the fixed orientation or position of the female setback member 74.

At the same time, support of the weight of the roof 12 is provided through the pan-connected hinge 82 and the cooperative guide channel 86 to the fixed female setback member 74 even during angular pitch adjustment of the roof. The roof is flushly supported atop the male hinge member 76, which is in turn non-releasably and adjustably connected atop the fixed female beam member 74. It is accordingly unnecessary to lock or otherwise fix the adjusted angular relation of the cooperating member 74, 76 once the pitch of the roof has been selected since any further shift in the pitch of the roof that might occur will automatically be accommodated by the hinged upper setback beam 72. On the other hand, further angular shifts in the pitch of the roof will generally be prevented by the provision of additional support structures at other locations on the roof.

When used in conjunction with the front fascia gutter assembly 20, the upper setback beam 72 mates with a correspondingly elongated lower setback beam generally designated 100 in FIG. 6 A base 102 supports a pair of opposingly parallel, upwardly depending sidewalls 104 preferably spaced apart an amount equal to the spacing between the upper beam wall extensions 98 and bounding with the base 102 a substantially U-shaped cross-sectional configuration of the lower setback beam 100. The base 102 terminates along one of its lateral edges in a shelf-like extension 106 beyond its juncture with the respective wall 104. Like each of the structures thus far described in connection with the present invention, the lower setback beam 100 may conveniently be extruded or otherwise unitarily fabricated of a lightweight, metallic construction material such as aluminum which provides considerable structural rigidity and strength under varying load conditions.

Connection of the upper and lower setback beams 72, 100 is generally effected with a plurality of extension tubes 108 spaced apart along the elongation thereof and which for convenience of description are assumed to have a square cross-sectional shape. The width or transverse extent of each wall of the tube 108 substantially conforms to the internal spacing between the opposed, parallel sidewalls 104 of the lower setback beam 100 and between the similarly opposed wall extensions 98 so that opposite ends of the extension tube 108 somewhat snugly abut the interior faces of the walls 104 and 98 of the lower and upper beams 100, 72 respectively. Rivets 110 or the like may be provided to secure each of the upper and lower setback beams to opposite ends of the extension tube 108 spacedly connecting the same so as to form an integral setback beam assembly 22 substantially as shown in FIG. 1. FIG. 1 also depicts the use of supporting posts or columns 112 connected to the underside of the lower setback base 102, as for example through a U-shaped shoe 114, for supportedly maintaining the setback beam assembly 22 in an elevationally spaced relation above the underlying ground surface. Screening 115 connected between adjacent ones of the support posts 112 may be utilized to form the room-bounding walls of the enclosed area covered by the roof 12.

The base extension 106 of the lower setback beam 100 supports one end of a plurality of spaced-apart, elongated projection arm beams 116 which are carried at their opposite ends on a similar shelf-like extension 40 of the front fascia gutter base 30. The projection arms 116 contribute, in conjunction with the inherent rigidity and structural strength of the roof pans 14, to the indirect or recessed support of the front fascia gutter assembly 20 connected to the leading edge of the roof 12. Those skilled in the art will readily recognize that the rigid projection arms 116 are effective to brace the leading or front portion of the roof against bending deformation under the weight of liquid runoff from the roof which collects in the drain gutter 44. Put another way, the front fascia gutter assembly 20, and the freely overhanging leading edge portion of the roof to which the same is secured, are indirectly supported by a combination of the setback posts or columns 112, the projection arm beams 116 rigidly connecting the front fascia gutter assembly 20 with the setback beam assembly 22, and the inherent structural rigidity of the roof pans 14.

FIG. 7 illustrates a somewhat modified lower setback beam which is designated 100' and which is utilized in the setback beam assembly 22 in FIG. 1. In addition to the structural features previously described, the beam 100' includes a trim cavity 118 on the outwardly facing surface of each of the sidewalls 104 for receiving a decorative header or fascia panel 120 between each trim cavity 118 and a correspondingly aligned trim cavity 122 on the female member 74 of the upper setback beam 72. As best seen in FIG. 1, this arrangement permits the connecting structure between the upper and lower setback beams 71, 100 to be concealed behind the fascia panels 120 so as to improve the finished appearance thereof.

The pitch-adjustable setback beam assembly 22 may also be employed for roof support independently of the front fascia gutter assembly 20. Under such conditions, the projection arm beams 116 which couple or connect the setback assembly 22 and front fascia gutter assembly 20 are clearly unnecessary and, as a consequence, the inclusion in the setback assembly 22 of the lower setback beam 100 which chiefly functions as a support for one end of the projection arms 116 may be eliminated. Ground-based supporting posts or columns, such as that identified by the reference numeral 112 in FIG. 1, can therefore be inserted directly into the cavity or opening of the upper setback beam 72 bounded by the wall extensions 98 so that the ends of the posts butt up against the shoulders 93 and their sidewalls are disposed substantially contiguous with the extensions 98. This arrangement provides a direct, column-supported roof support assembly which is pitch-adjustable to the selected slope of the roof and which is engageable with the same at virtually any location rearwardly set back from the roof's leading edge.

In order to assure satisfactory stability and rigidity in the direct, ground-based column support of the upper setback beam 72, the supporting columns utilized should fit relatively snugly into the opening of the female setback member 74 and contiguously against the wall extensions 98 so as to frustrate lateral motion of the column with respect to the female member 74. To achieve a relatively snug or close fit, the cross-sectional dimensions of the supporting columns must substantially correspond to the internal spacing between the setback walls 98. However, some roof constructions may require significantly less support than that provided by columns sized for a snug fit with the upper setback beam 72 and it may therefore be desired to utilize supporting columns of lesser cross-sectional extent without sacrificing stability of support in the roof construction.

FIGS. 4 and 5 depict unitarily-formed adapters generally designated 124, 124' respectively for enabling relatively snug-fitting acceptance in the upper setback beam 72 of supporting columns of lesser cross-sectional extent than the spacing between the setback wall extensions 98. Each of the adapters 124, 124', which are substantially identical but for the size of the supporting column each accepts, includes an engagement plate or key 126 having outwardly extending marginal edge portions 128 for sliding receipt in the end slots 94 of the setback beam keyway 96. A pair of opposed sidewalls 130 vertically extending from the plate 126 are spaced apart an amount corresponding to the transverse dimension of the supporting column 132 contiguously positionable therebetween. Each sidewall 130 carries an outwardly projecting positioning fin 134 of a length predetermined to abut the adjacent setback wall extension 98 so as to prevent relative lateral movement of the adapter 124 or 124' with respect to the female setback member 74. Thus, the adapters 124, 124' are engageable with the upper setback beam 72 to permit the use of supporting columns or posts 132 having a cross-sectional area less than that of the column-receiving opening in the female setback member 74.

There is seen in FIG. 8 a cross-sectional view of a pitch adjustable I-beam assembly 24 for providing additional support of the selectively sloped roof 12. It is intended that the assembly 24 generally be located at a position intermediate the forward and rear edges of the roof and, where the complete roof support structure also includes the setback beam assembly 22, rearwardly of such setback assembly. The constructural arrangement of the I-beam structure 24 enables it to support roof loads far in excess of the capacity of the setback beam 22 and it may accordingly be advantageously utilized where a relatively large or extensive roof structure is provided. In the typical arrangement in which the pitched roof 12 abuts or is attached at its rearward edge to the wall of an adjacent building, the I-beam assembly 24 may be connected to the roof at or adjacent the rearward edge thereof so as to generally absorb the weight of the roof and minimize loading forces on the abutting building wall. However, the specific location at which the beam assembly 24 is connected to the roof 12 is incidental to the invention and forms no part thereof.

More particularly, the pitch-adjustable I-beam assembly 24 is elongated as seen in FIG. 1 and comprises a fixed female I-beam member 136 and a variable-pitch head 138 hingedly or pivotally coupled thereto. The I-beam 136 may be unitarily formed as by extrusion and includes an upper base 140 and a lower base 142 spaced apart and held parallel by a central support 144. Both the upper and lower base 140, 142 are symmetrical about their juncture with the central support 144. Thus, the lower base 142 carries an upwardly-extending wall 146 depending from each of its lateral edges while the upper base 140 similarly carries at each of its lateral edges a downwardly-depending, arcuate guide surface 148 having a gradual or relatively large radius of curvature. A cross-sectionally arcuate pivot or guide channel 150 is defined at the juncture of each guide surface 148 with the respective lateral edge of the upper base 140.

The variable-pitch head 138 includes a support arm 152 for connection with the roof pans 14, as with screws 154, so that the head 138 is fixed or secured for movement with the roof 12 as its angular pitch is selectively adjusted. An extended hinge surface 156 having a gradual curvature conforming to that of the guide surface 148 depends from one lateral edge of the arm 152 while the arm is supported along its opposite edge by an essentially normally-depending leg 158. The leg 158 terminates in a substantially C-shaped hinge 160 pivotally non-releasably engageable by way of relative sliding movement in either one of the symmetrically opposed I-beam member guide channels 150, depending upon the direction of slope or pitch of the roof with respect to the ground-supported fixed I-beam member 136.

In the support of the selectively sloped roof 12, the variable-pitch head 138 is secured to the roof pans 14 so that the elongation of the head is disposed perpendicular to the desired direction of angular pitch of the roof. The I-beam member 136 to which the variable-pitch head is hingedly connected is positionally and angularly fixed with respect to and supported in elevationally spaced relation above the underlying ground surface by way of supporting columns or posts 162. Connection of the posts 162 to the I-beam member 136 may be facilitated by utilizing a substantially U-shaped connection shoe 164 sized to relatively snugly or closely accommodate the supporting posts and which may be secured to the lower base 142 in any conventional manner.

it will be recognized that the pivotal adjustability of the variable-pitch head 138 with respect to the I-beam member 136 as the slope of the roof pans 14 is selectively varied forms a cantilever-type arrangement about the interengaged hinge 160 and guide channel 150. During such pivotal adjustment or movement the hinge surface 156 slides along the contiguously disposed guide surface 148 and, when the angular adjustment of the roof has been completed, the curved hinge and guide surfaces 156, 148 may be relatively fixed with screws 166 connecting the same at spaced locations along their corresponding elongations. As a result of this securement of the relatively slidable surfaces 156, 148, further pivotal movement of the head 138 with respect to the female I-beam member 136 is prevented and the selected slope or pitch of the roof 12 is accordingly maintained while providing substantial load-handling support of the roof.

A modification of the variable-pitch I-beam assembly is illustrated in FIG. 9 and again designated 24. The sole structural differences between the assemblies in FIGS. 8 and 9 are present in the modified female I-beam member which is identified by the numeral 136' in FIG. 9. Specifically, the member 136' contemplates the accommodation of a decorative fascia or header panel 168 held between the twin cavities 170, 172 defined along the opposed edges of the upstanding walls 146 and curved guide surfaces 148 respectively. The header panel 168 closes and conceals the otherwise visible interior structure of the I-beam assembly 24 so as to improve the finished appearance of the supporting structure as seen from beneath the roof.

In addition, the modified female I-beam member 136' includes in its lower base 142 a generally T-shaped keyway 174 defined between end slots 176. The keyway 174 is arranged to receive a conformingly configured supporting column adapter 178 much like those previously described and designated 124 and 124' in FIGS. 4 and 5 respectively. Coupled engagement of the adapter 178 and I-beam keyway 174 facilitates securement of ground-base supporting posts or columns 162 to the I-beam member 136' as shown in FIG. 1.

A composite roof structure in accordance with the present invention might utilize any one or combination of the pitch-variable assemblies 20, 22, 24 herein disclosed. The operative selection of one or more of these assemblies in a roof construction will depend at least in part on the size or extent of the pitched roof to be supported, the nature or end use of the underlying area covered thereby and other decorative and functional design criteria chosen to suit the particular situation.

Of course, the major advantage inherent in the various structural assemblies of the invention is the ability of each to movably adjust one portion to the selected pitch of the roof while another portion to which the movable member is pivotally or hingedly connected remains positionally and angularly fixed with respect to the underlying ground suface. These supporting assemblies for the roof may accordingly be constructed and positionally fixed prior to construction of the roof surface and without regard to its final selected slope since the inventive assemblies are each independently pitch-adjustable. At the same time, each assembly provides for a transfer of the supported weight of the roof from its movable portion to its fixed portion at least partially through the hinged connection therebetween.

The ability of the support assemblies to adjust to the selected pitch of the roof and to be advantageously located at various positions along the slope of the roof and at predetermined elevations above the ground surface obviates the need to individually tailor or configure specially constructed elements of a roof support system which it would otherwise be necessary to provide. The present invention thus presents a universal support structure for a roof construction useful in a wide variety of roof-cover arrangements virtually without modification or individual tailoring of the adjustable assemblies irrespective of the selected pitch or size of the roof or of the open or enclosed nature of the covered area.

In addition, each of the pitch-adjustable assemblies disclosed provides the unique ability of fabrication by extrusion of a pair of hingedly engageable unitary members which carry cooperating hinge elements. Engagement and disengagement of the cooperating hinge elements is effected by way of relative sliding engagement therebetween and results in a hinged connection which is pivotally non-releasable. As a consequence, once the cooperating members of each pitch-adjustable assembly are interengaged or connected by sliding engagement of their respective hinge elements and secured to the overlying roof or underlying ground surface, disengagement in the course of pitch-adjustability of the roof is not possible. Put another way, detachment of the roof, as a unit, from the underlying support structure can be accomplished only by sliding the entire roof along the direction of elongation of the support assemblies so as to disengage the cooperating hinge elements. The roof support structure herein provided is accordingly immune to damage by severe weather conditions in which other known constructions could be lifted or otherwise detached from the underlying supports.

While there have been shown and described and point out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. In a pitched roof construction overlying a ground surface wherein the roof slopes downwardly in its outward extension from a building wall to which the rearwardly-disposed edge of the roof is secured, front fascia means on the roof along its front-disposed edge in elevated relation above the ground surface and including gutter-defining means for receiving and directing liquid runoff from the roof, and pitch-adjustable hanger means supportedly fixed to the roof at substantially its front-disposed edge and hingedly connected to said gutter-defining means for pivotal adjustment relative thereto in accordance with a selected pitch of the roof such that said gutter-defining means remains positionally and angularly fixed relative to the ground surface and irrespective of the selected pitch of the roof, and means supporting said front fascia means for carrying the same in said elevated relation above the ground surface.

2. In a pitched roof construction according to claim 1, said supporting means comprising a plurality of roof support posts connected between and relatively elevationally spacing said front fascia means from the underlying ground surface.

3. In a pitched roof construction according to claim 1, said supporting means comprising:

setback means supportingly connected with the roof at a location rearwardly-spaced from its front-disposed edge and including beam means positionally and angularly fixed with respect to the ground surface, and pitch-adjustable hinge means secured to the roof at said rearwardly-spaced location and hingedly connected to said beam means for pivotal movement relative thereto in accordance with the selected pitch of the roof, a plurality of roof support posts connected between and relatively elevationally spacing said setback means and the ground surface, and projection arm means connecting said setback means and said front fascia means to form a cantilever arrangement of the extension of the roof outward from said setback means.

4. In a pitched roof construction according to claims 2 or 3, girder means supporting the roof at a location intermediate its front and rearwardly-disposed edges and including I-beam means positionally and angularly fixed with respect to the ground surface, and pitch-adjustable pivot means connected to the roof at said intermediate location and hingedly connected to said I-beam means for pivotal movement relative thereto in accordance with the selected pitch of the roof, and a plurality of roof support posts connecting said girder means and the ground surface and relatively spacing the same so that said girder means is maintained in said fixed position elevationally above the ground surface.

5. In a pitched roof construction, a sloping roof, a setback beam supporting said sloping roof intermediate its ends, and means on said setback beam for adjustment to the angular slope of said roof, a pitch adjustment beam supporting said roof between said setback beam and the rearmost end of said roof, and means on said pitch-adjustment beam for adjustment to the angular slope of said roof, front fascia gutter means including a gutter member and adjustment means for engaging the leading edge of said sloping roof, said adjustment means being adjustable with respect to said gutter member to the angular position of the leading edge of said roof, and means on each of said adjustment means of said setback beam, pitch adjustment beam and front fascia gutter means for connection with said sloping roof.

6. In a pitched roof construction according to claim 5, each said adjustment means and its respective beam or fascia gutter means being extruded with integral hinge elements that cooperate with each other for relative pivotal movement therebetween.

7. In a pitched roof construction according to claim 6, said integral hinge elements on each said adjustment means being substantially C-shaped in cross-section for cooperative engagement with a conformingly arcuate channel on the respective beam or fascia gutter means such that each said cooperating pair of hinge elements is engageable and disengageable by way of relative sliding movement therebetween and said cooperating hinge elements are non-releasably engaged for relative pivotal adjustability.

8. A pitch-adjustable front fascia gutter assembly for connection with the leading edge of a selectively pitched roof supported in elevated relation above a ground surface, comprising:

gutter-defining means for collecting liquid runoff from the pitched roof;

hanger means for supportingly engaging the leading edge of the roof and pivotally adjustable with respect to said gutter-defining means to the angular position of the pitched roof;

and means connecting said gutter-defining means and said hanger means for relative pivotal adjustability therebetween such that adjustment of said hanger means to the selected angular position of the pitched roof is accomplished independent of and without affecting the relative angular position of said gutter-defining means.

9. A gutter assembly according to claim 8 wherein said gutter-defining means is engageable with a structural member for supporting the leading edge portion of the roof in elevated relation above the ground surface and further comprising:

a hinge member on said hanger means;

a guide surface on said gutter-defining means along which said hinge member is contiguously slidable as the angular position of said hanger means relative to said gutter-defining means is adjusted to the selected pitch of the roof;

and coupling means for relatively slidably fixing said hinge member and guide surface when the roof is adjusted to its selected angular position such that the weight of the leading edge portion of the roof is transferred at said coupled hinge member and guide surface from said roof-engaging hanger means to said gutter-defining means supported in elevated relation above the ground surface by the structural member.

10. A gutter assembly according to claim 8, said connecting means comprising hinge elements integrally extruded on each said gutter defining and hanger means that cooperate with each other for relative pivotal movement therebetween, said cooperative hinge elements being engageable and disengageable by way of relative sliding movement therebetween for non-releasable relative pivotal adjustability.

11. A gutter assembly according to claim 10, said hinge elements comprising an arcuate guide channel on said gutter-defining means and a substantially C-shaped member on said hanger means for slidably captured engagement and relative pivotal movement in said guide channel.

12. A gutter assembly according to claim 8, said gutter-defining means including a substantially U-shaped gutter;

and said hanger means including an integral wall face disposed substantially perpendicular to the angular pitch of the roof and a plurality of drainage holes defined in said wall face for communicating liquid runoff from the roof through said drainage holes to the interior of said U-shaped gutter.

13. A gutter assembly according to claim 8, further comprising:

hold-down means engageable with the roof and with said hanger means for facilitating the connection of said front fascia gutter assembly with the roof.

14. In a roof construction wherein a pitched roof is initially adjustable to a selected angular position, a pitch-adjustable front fascia gutter assembly for supporting the roof at its leading edge, comprising:

a unitary hanger member connected to the leading edge of the roof for supporting the same and for movement with the roof to its selectively angularly pitched position, said hanger member including an integral wall portion disposed contiguous with and substantially perpendicular to the leading edge of the roof and which is maintained in said relatively perpendicular orientation as the roof is initially adjusted to its selected angular pitch;

a front fascia member bounding an internally-defined gutter for the collection of liquid runoff from the pitched roof and including means hingedly connecting said front fascia member and said hanger member for relative pivotal adjustability of said hanger member to the selected pitch of the roof while said front fascia member is maintained positionally and angularly fixed with respect to an underlying ground surface;

a plurality of drainage holes defined in said hanger member so that liquid runoff from the roof is communicated through said drainage holes for collection in said internally-defined gutter;

and engageable means on said hanger member and on said front fascia member for securing the relative pivotal position therebetween after adjustment to the selected angular position of the roof and for transferring support of the leading edge of the roof from said pitch-adjustable hanger member to said positionally and angularly fixed front fascia member.

15. A front fascia gutter assembly according to claim 14, said engageable means comprising a curved guide surface on said front fascia member and a correspondingly curved hinge member on said hanger member for substantially contiguous sliding movement along said guide surface as said hanger member is pivotally adjusted relative to said front fascia member to the selected angular position of the pitched roof.

16. A front fascia gutter assembly according to claim 14, said hinged connecting means comprising an arcuate channel defined on said front fascia member;

and a substantially C-shaped hinge on said hanger member for relative pivotal engagement in said arcuate channel such that said pivotally engaged hinge and channel are effective to contribute to said transfer of roof support from said hanger member to said front fascia member.

17. A front fascia gutter assembly according to claim 16, said arcuate channel and C-shaped hinge being integrally extruded on their respective members such that the same are engageable and disengageable by way of relative sliding movement therebetween for non-releasable relative pivotal adjustability.

18. In a selectively pitched roof construction, a setback beam assembly for supporting the roof at a location rearwardly of its leading edge and comprising:

an upper setback member positionally and angularly fixed with respect to the underlying ground surface;

a hinge member connected to the roof at said location rearward of its leading edge and movable with the roof as the same is adjusted to its selected angular pitch;

and means connecting said upper setback and hinge members for relative pivotal adjustment therebetween so that the angular orientation of said hinge is adjustable with the roof without affecting the fixed position of said upper setback beam with respect to the ground surface and support of the roof at said rearward location is provided by said upper setback member through said connecting means.

19. A setback beam assembly according to claim 18, said connecting means comprising a hinge element integrally extruded on each said upper setback and hinge member that cooperate with each other for relative pivotal movement therebetween such that said hinge elements are engageable and disengageable by way of relative sliding movement therebetween for non-releasable relative pivotal adjustability.

20. A seback beam assembly according to claims 18 or 19 wherein said connecting means comprises:

an arcuate guide channel defined in said upper setback member;

and a substantially C-shaped hinge on said hinge member for relative pivotal engagement in said guide channel, said guide channel being predetemi-nately configured for non-releasable retention of said hinge member during relative pivotal adjustment therebetween.

21. In a roof construction including at least a support column vertically extending from the ground surface, a setback beam assembly according to claim 18 and further comprising:

means on said upper setback member for engagingly accommodating the support column at an end of the column remote from the ground surface so as to supportedly maintain said setback member in fixed and elevationally spaced relation above the ground surface.

22. In a roof construction including at least a support column vertically extending from the ground surface, a setback beam assembly according to claim 18 and further comprising:

a lower setback member for supported engagement with the support column at a position remote from the ground surface;

and an extension tube engageable at opposite ends with the upper and lower setback members for connecting the same in spaced apart relation so as to complete an integral roof-supporting setback assembly elevationally spaced above the ground surface by the support column.

23. In a roof construction including gutter means on the leading edge of the roof, a setback beam assembly according to claim 22 and further comprising:

an extension shelf on said lower setback member;

and projection arm means supported at one end on said extension shelf and connecting said setback assembly and the gutter means so as to positionally brace and facilitate support of the leading edge of the roof.

24. A pitch-adjustable beam assembly for supporting a selectively pitched roof, comprising:

an I-beam member positionally and angularly fixed in elevated relation with respect to the underlying ground surface;

a variable pitch head secured to the roof for movement therewith as the roof is adjusted to a selected angular pitch;

means hingedly connecting said I-beam member and variable pitch head for relative pivotal movement therebetween whereby angular adjustment of the roof causes corresponding movement of said variable pitch head relative to but without affecting the fixed position of said I-beam member;

a guide surface on each of said I-beam member and variable pitch head positioned for substantially contiguous relative sliding movement therebetween as the relative angular position of said variable pitch head and I-beam member is pivotally varied during selective adjustment of the roof pitch;

and means for connecting said guide surfaces and thereby fixing their relative positions when the roof has been adjusted to a selected pitch so as to prevent further pivotal adjustment of said variable pitch head angularly with respect to said I-beam member.

25. A pitch-adjustable beam assembly according to claim 24, said hinged connecting means comprising a hinge element on each said I-beam member and variable pitch head that cooperate with each other for relative pivotal movement therebetween.

26. A pitch-adjustable beam assembly according to claims 24 or 25, said variable pitch head including a support arm for securement to the roof and said arm carrying at respective opposite ends along the direction of roof pitch said guide surface of said head and said hinged connection to said I-beam member.

27. A pitch-adjustable beam assembly according to claim 26, said hinged connection means comprising:

an arcuate guide channel defined on said I-beam member;

and a substantially C-shaped hinge unitarily carried on one end of said support arm of the vehicle pitch head for non-releasable engagement in said guide channel and relative pivotal movement therewithin, said guide channel and C-shaped hinge being engageable and disengageable by way of relative sliding movement therebetween.

28. A pitch-adjustable beam assembly according to claim 24, said guide surface on each said I-beam member and variable pitch head being conformingly curved for substantially contiguous relative sliding movement therebetween.

29. In a pitch-adjustable universal support assembly for a selectively pitched roof construction, adjustable means secured to the roof and movable therewith as the roof is adjusted to a selected angular pitch for directly bearing the weight of the roof, stationary gutter means maintained in elevationally fixed relation with respect to the underlying ground surface and providing a ground-based positionally fixed support for the weight of the roof, and means hingedly connecting said stationary gutter and adjustable means for angular movement of said adjustable means relative to said stationary gutter means as the pitch of the roof is selectively varied without affecting the fixed position of said stationary gutter means so that construction of said support assembly may be completed prior to fabrication of the overlying roof and without regard to the final selected angular pitch thereof, and for transferring support of the weight of the roof from said direct roof-bearing adjustable means to said ground-based stationary gutter means so as to support the roof during and after selective pitch adjustment thereof as though said support assembly were specially fabricated as a unitary structure predeterminately and non-adjustably configured for the final selected pitch of the roof.

30. In a pitch-adjustable universal support assembly according to claim 29, said hinged connecting means comprising:

an arcuate channel defined on and extruded integral with said stationary gutter means, and a curved hinge on and extruded integral with said adjustable means for pivotally movable engagement in said channel as the angular position of said adjustable means is varied with respect to said stationary gutter means.

31. In a pitch-adjustable universal support assembly according to claim 30, said hinge being substantially C-shaped, and said arcuate channel having a substantially circular cross-section having an extent greater than a semi-circular arc for captured and non-releasable sliding engagement of said C-shaped hinge in said channel.

* * * * *